US006706123B2

(12) United States Patent
Fristad et al.

(10) Patent No.: US 6,706,123 B2
(45) Date of Patent: Mar. 16, 2004

(54) PHOSPHATE CONVERSION COATING CONCENTRATE

(75) Inventors: William E. Fristad, Rochester Hills, MI (US); Karim I. Saad, Rochester Hills, MI (US)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 10/343,577

(22) PCT Filed: Jul. 31, 2001

(86) PCT No.: PCT/US01/24154

§ 371 (c)(1),
(2), (4) Date: Jan. 31, 2003

(87) PCT Pub. No.: WO02/10476

PCT Pub. Date: Feb. 7, 2002

(65) Prior Publication Data

US 2003/0209289 A1 Nov. 13, 2003

Related U.S. Application Data

(60) Provisional application No. 60/222,169, filed on Aug. 1, 2000.

(51) Int. Cl.[7] ..... C23C 22/05; C23C 27/07

(52) U.S. Cl. ..... 148/259; 106/14.12; 106/14.44; 148/243; 148/253

(58) Field of Search ..... 148/243, 253, 148/259; 106/14.12, 14.44

(56) References Cited

U.S. PATENT DOCUMENTS

| | | | | |
|---|---|---|---|---|
| 4,289,826 | A * | 9/1981 | Howell, Jr. | 428/418 |
| 4,878,963 | A | 11/1989 | Bibber | |
| 5,089,349 | A | 2/1992 | Kaiser | |
| 5,238,505 | A | 8/1993 | Kaiser | |
| 6,179,934 | B1 | 1/2001 | Kawakami et al. | |

* cited by examiner

*Primary Examiner*—Anthony J. Green
(74) *Attorney, Agent, or Firm*—Stephen D. Harper; Mary K. Cameron

(57) ABSTRACT

A liquid iron phosphating concentrate is provided which contains dispersed aromatic carboxylic acid. The aromatic carboxylic acid remains dispersed in the concentrate by incorporation of a thickener in the composition.

20 Claims, No Drawings

PHOSPHATE CONVERSION COATING CONCENTRATE

This application claims priority from International application No. PCT/US01/24154, filed Jul. 31, 2001 and published in English, and from United States provisional application Ser. No. 60/222,169, filed Aug. 1, 2000.

BACKGROUND OF THE INVENTION

This invention relates to the well known general field of phosphate conversion coating of metals, particularly to the type of phosphate conversion coating known as iron side or non-crystalline conversion coating that is formed on predominantly ferriferous surfaces from a working phosphating composition that does not contain any substantial amount of any divalent cations that form insoluble phosphates, for example, zinc, nickel, cobalt, manganese, calcium, magnesium, or the like. For brevity hereinafter, this type of coating or of composition for forming is called simply iron phosphate or a grammatical variation thereof. The invention relates still more particularly to an aqueous liquid concentrate that can be converted to a complete working liquid iron phosphating composition by dilution with water only.

It is known that many iron phosphating processes are subject to the disadvantage of flash rust(ing) on or of the freshly phosphated surface within a few minutes of emergence of the phosphate coated surface from the rinses following phosphating. It has also been known that addition of an aromatic carboxylic acid, particularly benzoic acid, to a working iron phosphating liquid composition substantially mitigates the likelihood of such flash rust formation. However, the concentration of aromatic carboxylic acid required to produce this effect is fairly close to the solubility of aromatic carboxylic acid in a typical working iron phosphating composition. Therefore, a single package concentrate with as much as even twice the desired concentrations of all ingredients of a working iron phosphating composition that contains a flash rust-inhibiting concentration of dissolved aromatic carboxylic acid has not heretofore been possible. In order to use aromatic carboxylic acid in a working iron phosphating composition for effectively inhibiting flash rust, it has been necessary to supply aromatic carboxylic acid in a separate package from the other ingredients of a concentrate iron phosphating composition. This need for two packages is regarded as an inconvenience by many users and increases the chances that the optimum ratio between dissolved aromatic carboxylic acid and other constituents of a working iron phosphating composition will not be maintained.

Accordingly, a major object of this invention is to provide a single package concentrate iron phosphating composition that makes it possible to obtain the advantages of a flash rust-inhibiting concentration of aromatic carboxylic acid in a working iron phosphating composition without requiring addition of any substance other than water to the concentrate. Other alternative and/or more detailed objectives will be apparent to those skilled in the art from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); the term paint and all of its grammatical variations are intended to include any similar more specialized terms, such as lacquer, varnish, electrophoretic paint, top coat, color coat, radiation curable coating, or the like and their grammatical variations; and the term "mole" means gram-mole and the term itself and its grammatical variations may be applied to elemental, ionic, and any other chemical species defined by number and type of atoms present, as well as to compounds with well defined molecules.

BRIEF SUMMARY OF THE INVENTION

It has surprisingly been found that a dispersion of aromatic carboxylic acid in the other ingredients of an iron phosphating concentrate composition can be provided with sufficient stability to have practical value as a single package concentrate. One embodiment of the invention is a process for making such a stable dispersion. Another embodiment is such a stable dispersion itself, and still another embodiment is a process of using a working composition made from such a stable dispersion for phosphating.

DETAILED DESCRIPTION OF THE INVENTION AND PREFERRED EMBODIMENTS

A concentrate composition according to the invention preferably comprises, more preferably consists essentially of, or still more preferably consists of, water and the following components:

(A) a component of dissolved phosphate anions;

(B) a component of sufficient dissolved acid to give the concentrate composition itself and a working composition made by diluting the concentrate composition with water only, an acidic pH value;

(C) a component of dispersed aromatic carboxylic acid; and (D) a component of viscosity increasing agent that is not part of any of components (A) through (C) as recited immediately above; and, optionally, none, one or more of dissolved aromatic carboxylic acid and the following components:

(E) a component of phosphating accelerator that is not part of any of components (A) through (D) as recited immediately above;

(F) a component of dissolved fluoride ions that are not part of any of components (A) through (E) as recited immediately above;

(G) a component of chelating agent that is not part of any of components (A) through (F) as recited immediately above;

(H) a component of acidity adjustment agent that is not part of any of components (A) through (G) as recited immediately above; and (J) a component of one or more surfactants that are not part of any of components (A) through (H) as recited immediately above.

In a composition according to the invention, component (A) preferably, at least for economy, is sourced to a composition according to the invention by at least one of orthophosphoric acid and its salts of any degree of neutralization. Component (A) can also be sourced to a composition according to the invention by pyrophosphate and other more highly condensed phosphates, including metaphosphates, which tend at the preferred concentrations for at least working compositions according to the invention to hydrolyze to orthophosphates. However, inasmuch as the condensed phosphates are usually at least as expensive as orthophosphates, there is little practical incentive to use condensed phosphates, except to prepare extremely highly concentrated liquid compositions according to the invention, in which condensed phosphates may be more soluble.

Whatever its source, the concentration of component (A) in a concentrate composition according to the invention, measured as its stoichiometric equivalent as $H_3PO_4$ with the stoichiometry based on equal numbers of phosphorus atoms, preferably is at least, with increasing preference in the order given, 2.0, 3.0, 4.0, 5.0, 6.0, 7.0, 8.0, 9.0, 10.0, 10.5, 11.0, 11.3, or 11.6% and independently preferably is not more than, with increasing preference in the order given, 40, 35, 30, 25, 20, 18, 16, 14.0, 13.0, 12.5, 12.0, or 11.7%. If the concentration of phosphate is too low, either the shipping cost of the concentrate will be high, because of its high water content, or the speed of phosphating in a working composition made from the concentrate composition generally will be slower than desirable. If this concentration of phosphate (or any other ingredient except water) is too high, the concentrate is more likely to become inhomogeneous on storage for a prolonged period.

Component (B), primarily for economy, is preferably supplied primarily by one or more of the acids listed in the description of component (A) above. Preferred amounts of acid are most practically specified in terms of actual or hypothetical working compositions to be made from the concentrate compositions. In such a working composition, it is preferred, independently for each characteristic, that:

the concentration of free acid be at least, with increasing preference in the order given, 0.5, 0.3, 0.10, 0.00, 0.05, 0.10, 0.15, or 0.20 points and independently preferably be not more than, with increasing preference in the order given, 4.0, 3.0, 2.5, 2.3, 2.1, 1.9, 1.7, 1.5, 1.3, 1.10, or 1.00 points;

the concentration of total acid be at least, with increasing preference in the order given, 3.0, 3.5, 4.0, 4.5, 5.0, 5.3, 5.6, 5.8, or 6.0 points and independently preferably be not more than, with increasing preference in the order given, 12, 10, 9.0, 8.0, 7.5, 7.0, 6.5, or 6.1 points; and the pH value of a working composition according to the invention be at least, with increasing preference in the order given, 3.0, 3.5, 4.0, 4.3, or 4.5 and independently preferably be not more than 7.0, 6.5, 6.0, 5.7, or 5.5.

("Points" are defined for this purpose as the number of milliliters (this unit of volume being hereinafter usually abbreviated as "ml") of 0.10 N NaOH solution required to titrate a 10 ml sample of the composition, to a phenolphthalein or pH 8.0 end point for total acid and a bromphenol blue or pH 3.8 end point for free acid. If necessary because of the initial pH value of the solution, 0.10 N strong acid titrant is substituted for the NaOH solution, and the points are then recorded as negative.) If the number of points of free acid is too high or the pH too low, excessive dissolution of the substrate being phosphated will usually occur, and the desired dispersion of aromatic carboxylic acid will usually be unstable, while if the points of free acid are too low or the pH too high, an undesirably slow rate of deposition of the phosphate coating will usually be observed. If the total acid points are too low, the total acid will be less effective in maintaining the desired free acid concentration in the vicinity of the substrate being coated, where free acid is consumed by the reactions that result in forming the phosphate coating. If the total acid points are too high, there will be excessive cost without any corresponding benefit and the desired dispersion of aromatic carboxylic acid will usually be destabilized.

If the working composition to be made from a concentrate composition according to the invention is not otherwise specified, a working composition made by mixing 1.0 part of the concentrate composition with 19 parts of deionized water is to be used for testing whether the concentrate composition conforms with the preferences for acid points and pH stated above.

Component (C) of aromatic carboxylic acid preferably is selected from acids that meet at least one, and more preferably more than one, most preferably all, of the following criteria, each of which is independently preferred:

the molecules of the acids contain not more than, with increasing preference in the order given, 20, 18, 16, 14, 12, 10, 9, 8, or 7 carbon atoms each; and the acid is soluble in pure water at 17.5° C. to an extent of at least, with increasing preference in the order given, 0.02, 0.04, 0.06, 0.08, 0.10, 0.12, 0.14, 0.16, 0.18, or 0.20 parts of acid per 100 parts of water.

The single most preferred aromatic carboxylic acid is benzoic acid.

The concentration of aromatic carboxylic acids, including both dispersed and dissolved acids present in a concentrate composition according to the invention, preferably is at least, with increasing preference in the order given, 0.5, 1.0, 1.5, 2.0, 2.5, 2.7, or 2.9% and independently preferably is not more than, with increasing preference in the order given, 10, 8, 6.0, 5.0, 4.5, 4.0, 3.5, or 3.1%. In addition and independently, the ratio of aromatic carboxylic acids to component (A) measured as its stoichiometric equivalent as $H_3PO_4$ preferably is at least, with increasing preference in the order given, 0.05:1.00, 0.10:1.00, 0.15:1.00, 0.20:1.00, 0.22:1.00, or 0.24:1.00 and independently preferably is not more than, with increasing preference in the order given, 0.75:1.00, 0.50:1.00, 0.40:1.00, 0.35:1.00, 0.33:1.00, 0.31:1.00, 0.29:1.00, or 0.27:1.00. If either the concentration of aromatic carboxylic acid or its ratio to the concentration of phosphoric acid is too low, the desired benefit of protecting the phosphated substrate against flash rusting is less likely to be realized, while if the concentration or ratio is too high, the desired dispersion of aromatic carboxylic acid in the concentrate composition will usually be destabilized and/or there will be additional cost without any offsetting benefit.

Component (D) of viscosity increasing agent may be selected from a wide variety of viscosity increasing agents, such as natural and synthetic poly-saccharides and derivatives thereof, latexes incorporating a polymer with a viscosity strongly dependent on pH, and other materials, as known in the art. Xanthan gum is most preferred and, when used as the only ingredient included primarily as a viscosity increasing agent, preferably has a concentration in a concentrate composition according to this invention that is at least, with increasing preference in the order given, 0.05, 0.10, 0.15, 0.20, 0.25, 0.30, 0.35, 0.40, 0.43, or 0.46% and independently preferably is not more than, with increasing preference in the order given, 1.5, 1.0, 0.90, 0.80, 0.75, 0.71, or 0.68%. If some other viscosity modifying agent is used, it preferably is used in a concentration to produce the same static viscosity in the composition as is produced by one of the above-stated preferred amounts of xanthan gum. If there is too little viscosity increasing agent in a composition according to this invention, the storage stability of the dispersed aromatic carboxylic acid is greatly reduced. With too much viscosity increasing agent, on the other hand, the concentrate would be impracticable to use on a large scale, because of the difficulty of pumping or otherwise efficiently moving it.

Component (E) of phosphating accelerating agent(s) preferably is included in a concentrate composition according to the invention, because without it the phosphating reaction in a working composition made by diluting the concentrate composition with water only normally will be undesirably slow. The accelerator when present in a concentrate composition according to the invention preferably is selected from the group consisting of: 6 to 80 parts of chlorate ions per thousand parts of total working phosphating composition, this unit of concentration being freely used hereinafter for any constituent of any composition and being hereinafter usually abbreviated as ppt; 1.0 to 40 ppt of m-nitrobenzene sulfonate ions; 1.0 to 40 ppt of m-nitrobenzoate ions; 1.0 to 40 ppt of p-nitrophenol; 0.10 to 3.0 ppt of hydrogen peroxide in free or bound form; 0.4 to 50 ppt of hydroxylamine in free or bound form; 2.0 to 100 ppt of a reducing sugar; and 20 to 600 ppt of nitrate ions.

In one particularly preferred embodiment of the invention, component (E) contains, preferably consists essentially of, or more preferably consists of, two distinct subcomponents as follows:

(E.1) a subcomponent of water soluble source(s) of dissolved hydroxylamine; and (E.2) a subcomponent of one or more dissolved oxidizing agents selected from the group consisting of nitroaromatic organic compounds, molybdate and condensed molybdate ions having the general formula $Mo_nO_{(3n+1)}^{-2}$ where n represents a positive integer, tungstate ions, and mixtures thereof.

Subcomponent (E.1) may consist of any of hydroxylamine itself, salts of hydroxylamine, complexes of hydroxylamine, and even oximes, which produce hydroxylamine by hydrolysis in aqueous solutions. Primarily for economy, safety, and convenience, hydroxylamine sulfate is most preferred. Whatever the source of subcomponent (E.1), its concentration, measured as its stoichiometric equivalent as hydroxylamine, in a concentrate composition according to the invention preferably is at least, with increasing preference in the order given, 0.04, 0.08, 0.15, 0.20, 0.25, 0.30, 0.35, 0.38, 0.40, or 0.42% and independently preferably is not more than, with increasing preference in the order given, 5, 3, 2.0, 1.0, 0.80, 0.70, 0.60, 0.55, 0.50, 0.47, 0.45, or 0.43%. If the concentration of hydroxylamine is too low, the rate of formation of the phosphating coating will be undesirably slow, while if this concentration is too high, the cost of a composition according to the invention will be increased without any offsetting benefit.

There are two alternative preferred choices for subcomponent (E.2), depending on whether a colored, readily visible conversion coating or a nearly colorless and transparent conversion coating with better corrosion resistance is desired. If a colored coating is desired, the most preferred sources of subcomponent (E.2) are water soluble salts of one of the molybdic acids, most preferably of $H_2MoO_4$. This component provides a dark blue colored conversion coating that is easy to detect visually and gives good corrosion protection, adequate for many purposes. This embodiment is generally preferred by users who do not wish to quantitatively monitor the thickness of the coating produced. In a concentrate composition of this embodiment, it is preferred, with increasing preference in the order given, that the total concentration of all molybdate salts be in the range from 0.0004 to 0.40, 0.004 to 0.40, or 0.04 to 0.40 moles per liter (hereinafter "M") of total molybdate salts.

The alternative highly preferred choice for subcomponent (E.2), which produces the maximum possible corrosion resistance, is meta-nitrobenzene sulfonic acid and/or its water soluble salts, especially the sodium salt. The conversion coating layer produced by this embodiment is often difficult to detect visually, but the thickness of the coating can be readily determined by the quantitative methods known to those skilled in the art, which generally involve weighing a sample of the coating before and after using an appropriate stripping solution composition to remove the conversion coating. In a concentrate composition according to this embodiment, it is preferred, with increasing preference in the order given, that the concentration of subcomponent (E.2) be at least, with increasing preference in the order given, 0.3, 0.5, 0.7, 0.90, 1.0, 1.20, 1.30, 1.40, or 1.50% and independently preferably be not more than, with increasing preference in the order given, 10, 7, 5, 4.0, 3.0, 2.5, 2.20, 2.00, 1.90, 1.80, 1.75, 1.70, 1.65, 1.60, or 1.55%.

Whatever is used for subcomponent (E.2), if its concentration is too low, the phosphate coating is likely to form at an impractically slow rate from a working composition made by diluting a concentrate composition according to the invention with water, while if the (E.2) concentration is too high, the composition will be excessively costly without any offsetting benefit.

The presence of optional component (F) of dissolved fluoride in a composition according to the invention is also preferred, at least in part because this component provides a buffering effect for free acid concentration and usually results in better coating quality. More preferably, this fluoride is sourced to the composition in two differing forms: uncomplexed fluoride supplied by hydrofluoric acid and/or one of its salts (which may be partially or totally neutralized); and complexed fluoride supplied by at least one of the acids $HBF_4$, $H_2SiF_6$, $H_2TiF_6$, $H_2ZrF_6$, and $H_2HfF_6$, and their salts (which also may be partially or totally neutralized). Among this group, $NaBF_4$ is most preferred, primarily for economy and ready commercial availability. Whatever material is used as the source, any fluoride added from a source of complexed fluoride is presumed, for the purpose of testing conformity with the preferences below, to remain as complexed fluoride in the concentrate composition, and likewise any fluoride added as uncomplexed fluoride is assumed to remain uncomplexed in the concentrate composition. When both uncomplexed and complexed fluorides are present in a concentrate phosphating composition according to the invention. The concentration of uncomplexed fluoride in the concentrate phosphating composition preferably is at least, with increasing preference in the order given, 0.20, 0.40, 0.50, 0.60, 0.70, 0.80, 0.85, 0.90, 0.95, or 0.98% and independently preferably is not more than, with increasing preference in the order given, 10, 7, 5, 4.0, 3.0, 2.5, 2.0, 1.8, 1.6, 1.4, 1.30, 1.20, 1.10, or 1.00%; independently, the concentration of complexed fluoride in the phosphating composition preferably is at least, with increasing preference in the order given, 0.10, 0.20, 0.30, 0.40, 0.50, 0.60, 0.70, 0.80, 0.85, 0.87, or 0.89% and independently preferably is not more than, with increasing preference in the order given, 8.5, 7.5, 6.5, 5.5, 4.5, 3.5, 2.5, 2.0, 1.5, 1.3, 1.10, 1.00, 0.95, or 0.92%; and, independently, the ratio of uncomplexed fluoride to complexed fluoride preferably is at least, with increasing preference in the order given, 0.1:1.00, 0.3:1.00, 0.5:1.00, 0.70:1.00, 0.80:1.00, 0.90:1.00, 1.00:1.00, or 1.10:1.00 and independently preferably is not more than, with increasing preference in the order given, 8:1.00, 6:1.00, 4:1.00, 3.0:1.00, 2.5:1.00, 2.0:1.00, 1.7:1.00, 1.50:1.00, 1.40:1.00. 1.30:1.00, 1.25:1.00, 1.20:1.00, 1.18:1.00, 1.16:1.00, 1.14:1.00, or 1.12:1.00.

If a phosphating composition according to the invention contains either fluoride only in uncomplexed form or fluoride only in complexed form, the total fluoride content of the composition preferably is at least, with increasing preference in the order given, 0.50, 1.0, 1.3, 1.6, or 1.8% and independently preferably is not more than, 8, 6, 4.0, 3.0, 2.5, 2.2, or 1.9%.

Component (G) of chelating agent is preferably present in a composition according to the invention, because if it is not present or its concentration is too low, the speed of formation of the phosphate conversion coating with a working composition made by diluting a concentrate composition according to the invention with water only will usually be less than desirable and/or a large amount of iron phosphate sludge is more likely to be formed during use of the composition. This component (G) preferably is selected from molecules each of which contains at least two moieties selected from the group consisting of —COOH, —OH, and mixtures thereof. Citric acid and gluconic acid and/or their salts are the most preferred chelating agents, citric acid and its salts being preferred over gluconic acid because they are more effective in reducing sludge. If gluconic acid or citric acid is used, its concentration in a concentrate composition according to the invention preferably is at least, with increasing preference in the order given, 0.02, 0.04, 0.06, 0.08, 0.10, 0.12, 0.14, or 0.16% and independently preferably is not more than, with increasing preference in the order given, 1.0, 0.8, 0.6, 0.40, 0.35, 0.30, 0.25, or 0.20%. If salts, mixtures, and/or other chelating agents are used, the total concentration of component (G) is preferably measured as its stoichiometric equivalent as gluconic acid, the stoichiometry being based on equal numbers of chelating agent molecules, and when so measured has the same concentration preferences as for gluconic acid itself when used alone as component (G).

Component (H) of acidity adjustment agent also is normally preferably present in a composition according to the invention, if only because it is needed in a preferred process for making a composition according to the invention and removing it would add an unnecessary cost. When all of the phosphate needed is supplied by phosphoric acid, as has already been noted to be generally preferred, the phosphoric acid will normally supply more Total and Free Acid points than are preferred, so that an alkalinizing acidity adjustment agent is generally needed for this purpose also. An alkali metal hydroxide is most preferred as the alkalinizing agent, although any other sufficiently strongly ionized source of alkalinity is suitable. The concentration, measured as its stoichiometric equivalent as sodium hydroxide, with the stoichiometry being based on equal content of acid-neutralizing-alkalinity, preferably is at least, with increasing preference in the order given, 1.0, 2.0, 3.0, 4.0, 4.5, 4.8, or 5.1% and independently preferably is not more than, with increasing preference in the order given, 15, 12, 10, 8, 7.0, 6.5, 6.0, or 5.5%. If this concentration is either too low or too high, the already stated preferences for Free Acid, Total Acid, and pH of working compositions made by diluting a concentrate composition according to the invention with water only will not usually be obtained, and the concentration preferences for component (H) are subordinate to these already stated preferences.

Component (J) of one or more surfactants is preferably included in a concentrate composition according to the invention, at least if the working compositions made by diluting the concentrate compositions according to the invention with water only are to be used with little or no precleaning of the substrates to be phosphated, as is often preferred. On the other hand, if separate cleaning processes sufficient to assure thorough cleanliness of the substrate surfaces being phosphated are used, the surfactants may be and preferably are omitted to reduce the cost of the compositions. Preferred surfactants are shown in the working examples.

A concentrate composition according to the invention preferably does not develop any separation into two or more phases that is visually detectable with unaided normal human vision within a time interval of at least, with increasing preference in the order given, 10, 20, 40, 80, or 150 days after it has been manufactured.

For various reasons, almost always including at least a cost saving from elimination of an unnecessary ingredient, it is preferred that a composition according to this invention should be largely free from various materials often used in prior art compositions. In particular, compositions according to this invention in most instances preferably do not contain, with increasing preference in the order given, and with independent preference for each component named, more than 5, 4, 3, 2, 1, 0.5, 0.25, 0.12, 0.06, 0.03, 0.015, 0.007, 0.003, 0.001, 0.0005, 0.0002, or 0.0001% of each of (i) dissolved divalent cations of any of zinc, nickel, manganese, cobalt, copper, iron, calcium, and magnesium, (ii) dissolved cations of any kind with a valence of 3 or more, (iii) dissolved aluminum in any chemical form, and (iv) dissolved chromium in any chemical form.

A typical process according to the invention for making a selected mass of a concentrate composition according to the invention having a specified concentration of each of its ingredients, said ingredients including phosphoric acid, comprises at least the following operations:

(I) providing a first mass of liquid that includes water, alkalinizing agent, and dissolved aromatic carboxylic acid, said first mass having all of the following properties:

the first mass constitutes not more than, with increasing preference in the order given, 95, 85, 75, 65, 60, or 50% of the selected mass of the concentrate composition to be made;

the first mass comprises in dissolved salt form the entire content of aromatic carboxylic acid that is to be present in both dissolved and dispersed form in the selected mass of the concentrate composition to be made;

the first mass further comprises sufficient dissolved free alkali, i.e., alkali in excess of any material originally added as alkali that has reacted with any acidic material also added to or present in said first mass of liquid, so that there is a ratio in said first mass of moles of free alkali to moles of anions of aromatic carboxylic acid that is at least, with increasing preference in the order given, 0.5:1.00, 1.0:1.00, 2.0:1.00, 3.0:1.00, 3.5:1.00, 4.0:1.00, or 4.4:1.00 and independently preferably is not more than, with increasing preference in the order given, 10:1.00, 8:1.00, 6.0:1.00, 5.5:1.00, 5.0:1.00, 4.8:1.00, or 4.6:1.00; and (II) adding a liquid solution of phosphoric acid in water to said first mass slowly with stirring until the entire content of phosphoric acid to be included in the selected mass of concentrate composition has been added to and mixed with said first mass to form a second liquid mass.

The second liquid mass may or may not constitute the entire selected mass of concentrate composition to be made. If it does not, any additional ingredients needed are preferably added after operation (II) as described above, except that:

- any surfactant and/or any viscosity increasing agent that has a viscosity that does not decrease when acidized may equally preferably be added to the first mass or added to the second mass; and
- any acidic chelating agent to be included may equally preferably be included in the solution of phosphoric acid added during operation (II) as described above or added to the second mass.

Additionally and independently of the other preferences and of one another:

- any acid other than phosphoric acid or an aromatic carboxylic acid preferably is added after the second mass has been formed as described above;
- if hydrofluoric acid is one of the ingredients specified for the concentrate composition, it preferably is the last one, except possibly for water, added to the mixture of other ingredients;
- any ingredient other than water that is to be mixed into the second mass as described above preferably is dissolved in water when it is added; and
- if any material is required to be added after operation (II) as described above, stirring of the mixture is preferably maintained continuously from the beginning of the addition of phosphoric acid in operation (II) until all the specified ingredients to make the specified mass of concentrate composition have been mixed with one another.

It will be apparent to those skilled in the art that numerous trivial variations could be made in the process sequence as described above to achieve an equivalent result without departing from the spirit of the invention. For example, but without limitation:

- the first mass could be divided into two or more parts, each treated in the same manner as described above for the single first mass, and the resulting multiple second masses could be mixed together at the end to constitute the entire specified mass of concentrate composition;
- a single second mass could be divided into two or more parts, further materials added to at least one of the parts, and all of the resulting mixtures combined eventually to constitute the entire specified mass of concentrate composition; and/or
- operation (II) as described above could be interrupted before all of the required phosphoric acid has been added, then resumed later to complete operation (II).

In a process according to the invention for using a concentrate composition according to the invention, the concentrate is preferably diluted with an amount of water that is at least, with increasing preference in the order given, 3, 5, 7, 9, 11, 13, 15, 17, or 19 times its own mass to constitute a working phosphating composition, which is then used for phosphating in a manner known per se in the art for using other iron phosphating compositions. For the particularly preferred specific embodiments as described above:

- the temperature during contact between the metal treated and a working composition made by diluting a concentrate composition according to the invention preferably is in a range from, with increasing preference in the order given, 21 to 85, 25 to 70, or 30 to 65° C;
- the time of contact preferably is in a range from, with increasing preference in the order given, 5 seconds (hereinafter "sec") to 15 minutes (hereinafter "min"), 15 sec to 10 min, or 30 sec to 5 min; and
- the add-on mass of the phosphate coating formed preferably is in a range from, with increasing preference in the order given, 12 to 1600, 98 to 975, or 285 to 700, milligrams per square meter (hereinafter "mg/m$^2$) of surface treated.

The practice of this invention may be further appreciated by consideration of the following, non-limiting, working examples.

CONCENTRATE COMPOSITION and PROCESS EXAMPLES 1 and 2

The ingredients used for these two examples are shown in Table 1 below. For both examples, the manufacturing process was as described immediately below.

TABLE 1

| Ingredient | Parts of Ingredient in 300 Parts of Concentrate Example: 1 | 2 |
|---|---|---|
| Water | 184 | 184 |
| Xanthan gum | 2.0 | 1.4 |
| ANTAROX ™ LF-330 surfactant | 1.7 | 1.7 |
| TRITON ™ DF-16 surfactant | 5.2 | 5.2 |
| RHODAFAC ™ RP-710 surfactant | 1.0 | 1.0 |
| 50% solution of NaOH in water | 32 | 32 |
| 50% solution of gluconic acid in water | 1.7 | 1.7 |
| 75% solution of $H_3PO_4$ in water | 46 | 46 |
| 30% solution of hydroxylamine sulfate in water | 10.5 | 10.5 |
| sodium m-nitrobenzene sulfonate | 4.6 | 4.6 |
| 48% solution of HF in water | 2.1 | 2.1 |
| Solid $NaBF_4$ | 1.0 | 1.0 |
| Solid benzoic acid | 9.0 | 9.0 |

The xanthan gum was wetted with the surfactants noted in Table 1 and then dissolved together with the surfactants in one-half of the amount of water listed separately as an ingredient in Table 1. This mixture was stirred for about twenty minutes until thoroughly mixed. The sodium hydroxide solution was then added to this mixture while continuing stirring. The solid powdered benzoic acid was added next, with continued stirring, until all of the benzoic acid had dissolved (and had presumably been converted to sodium benzoate in solution). To the resulting mixture, the phosphoric acid solution was added next, with continued stirring until the entire amount had been added. (By the end of this addition, finely divided benzoic acid had been precipitated in the mixture but remained stably dispersed.) To the resulting mixture, the remaining components gluconic acid, hydroxylamine sulfate solution, sodium tetrafluoroborate, sodium meta-nitrobenzene sulfonate and hydrofluoric acid were added. The mixture continued to be stirred until the mixture was homogenous except for the suspended, fine benzoic acid particles. The stirring was then discontinued and the concentrate packed for storage.

The invention claimed is:

1. A liquid concentrate composition of matter that when mixed with 19 times its own mass of water is a solution that forms a phosphate conversion coating on a solid metal substrate with which it is contacted, said concentrate composition comprising water and:

(A) a component of dissolved phosphate anions in an amount sufficient to form the phosphate conversion coating on the substrate from a working composition made by diluting the concentrate composition with water only;

(B) a component of sufficient dissolved acid to give the concentrate composition itself and a working composition made by diluting the concentrate composition with water only, an acidic pH value;

(C) a component of dispersed aromatic carboxylic acid in an amount sufficient for the working composition to protect the phosphated substrate against flash rusting; and (D) a component of viscosity increasing agent that is not part of any of components (A) through (C) as recited immediately above.

2. The liquid concentrate composition of claim 1 further comprising at least one member selected from the group consisting of (E) a component of phosphating accelerator that is not part of any of components (A) through (D);

(F) a component of dissolved fluoride ions that is not part of any of components (A) through (E);

(G) a component of chelating agent that is not part of compounds (A) through (F);

(H) a component of acidity adjustment agent that is not part of any of components (A) to (G); and (J) a component of one or more surfactants that is not part of any of components (A) through (H).

3. The liquid concentrate composition of claim 1 comprising:

(A) 2% to 40% by weight dissolved phosphate ions; based on a stoichiometric equivalent as $H_3PO_4$;

(B) 3.0 to 12.0 points of total acid when diluted to working strength;

(C) 0.5% to 10.0% of at least one aromatic carboxylic acid containing from 7 to 20 carbon atoms;

(D) 0.05 to 1.5% of xanthan gum or optionally a viscosity modifying agent other than xanthan gum used in a concentration to produce a same "static" viscosity of the composition as the above stated amounts of xanthan gum; and (E) a phosphating accelerator in an amount sufficient to provide a working solution with a concentration of at least one member selected from the group consisting of 67 ppt to 80 ppt of chlorate ions, 1.0 ppt to 40 ppt of m-nitrobenzene sulfonate ions, 1 ppt to 40 ppt of m-nitrobenzoate ions, 1.0 ppt to 40 ppt of p-nitrophenol, 0.10 ppt to 3.0 ppt of hydrogen peroxide in free or bound form, 0.4 ppt to 50 ppt of hydroxylamine in free or bound form, 2.0 ppt to 100 ppt of a reducing sugar and 20 ppt to 600 ppt of nitrate ions.

4. The liquid concentrate composition of claim 3 wherein component (E) comprises at least two subcomponents (E.1) and (E.2) wherein (E.1) comprises a water soluble source of hydroxylamine and (E.2) comprises a member selected from the group consisting of nitroaromatic organic compounds, molybdate ions, condensed molybdate ions of the formula $Mo_nO_{(3n+1)}^{-2}$ wherein n represents a positive integer, tungstate ions, and mixtures thereof.

5. The liquid concentrate composition of claim 3 further comprising (F) at least one member selected from the group consisting of 0.2% to 10% of uncomplexed fluoride, 0.1 to 8.5% of complexed fluoride and mixtures thereof and wherein when both uncomplexed fluoride and complexed fluoride are present the ratio of uncomplexed fluoride to complexed fluoride is from 0.1:1.00 to 8.1.00 and when only uncomplexed fluoride or complexed fluoride is present the total fluoride content of the composition is from 0.50% to 8%.

6. The liquid concentrate of claim 3 further comprising (G) from 0.02% to 1.0% of a chelating agent wherein the concentration is measured as its stoichiometric equivalent as gluconic acid.

7. The composition of claim 3 further comprising (H) 1% to 15% of an acidity adjustment agent.

8. The composition of claim 3 further comprising (J) at least one surfactant.

9. The liquid concentrate of claim 3 wherein the ratio of aromatic carboxylic acids to component (A) measured as its stoichiometric equivalent as $H_3PO_4$ is from 0.05:1 to 0.75:1.

10. The liquid concentrate of claim 3 comprising (A) 5% to 25% by weight dissolved phosphate ions based on the stoichiometric equivalent as $H_3{=}PO_4$;

(B) 0 to 2.3 points of free acid when diluted to working strength;

(C) 1.5% to 6% of the at least one aromatic carboxylic acid containing from 7 to 20 carbon atoms; and (D) 0.20% to 1.0% of xanthan gum or optionally a viscosity modifying agent other than xanthan gum used in a concentration to produce the same static viscosity of the composition as the above stated amounts of xanthan gum.

11. The liquid concentrate of claim 5 further comprising (G) from 0.02% to 1% of a chelating agent wherein the concentration is measured as its stoichiometric equivalent as gluconic acid.

12. The liquid concentrate of claim 11 further comprising (H) 1% to 15% of an acidity adjusting agent.

13. The liquid concentrate of claim 12 further comprising (J) at least one surfactant.

14. A process for manufacturing a selected mass of a concentrate composition comprising water and a component of dissolved phosphate anions; a component of sufficient dissolved acid to give the concentrate composition itself and a working composition made by diluting the concentrate composition with water only, an acidic pH value; a component of dispersed aromatic carboxylic acid; and a component of Viscosity increasing agent, said process comprising operations of:

(I) providing a first mass of liquid that includes water, alkalinizing agent, and dissolved aromatic carboxylic acid, said first mass having all of the following properties:

the first mass constitutes not more than 95% of the selected mass of the concentrate composition to be made;

the first mass comprises in dissolved salt form the entire content of aromatic carboxylic acid that is to be present in the selected mass of the concentrate composition to be made;

the first mass further comprises sufficient dissolved free alkali, that is alkali in excess of any material originally added as alkali that has reacted with any acidic material also added to or present in said first mass of liquid, so that there is a ratio in said first mass of moles of free alkali to moles of anions of aromatic carboxylic acid that is at least 0.5:1.0; and (II) adding a liquid solution of phosphoric acid in water to said first mass slowly with stirring until the entire content of phosphoric acid to be included in the selected mass of concentrate composition has been added to and mixed with said first mass to form a second liquid mass.

15. A liquid concentrate composition of matter that when mixed with 19 times its own mass of water is a solution that forms a phosphate conversion coating on a solid metal substrate with which it is contacted, said concentrate composition comprising water and:

(A) a component of dissolved phosphate anions in an amount sufficient to form the phosphate conversion coating on the substrate from a working composition made by diluting the concentrate composition with water only;

(B) a component of sufficient dissolved acid to give the concentrate composition itself and a working composition made by diluting the concentrate composition with water only, an acidic pH value;

(C) a component of dispersed aromatic carboxylic acid, in an amount sufficient for the working composition to protect the phosphated substrate against flash rusting, said acid being soluble in water to an extent of at least 0.02 parts of acid per 100 parts of water; and (D) a component of viscosity increasing agent that is not part of any of components (A) through (C) as recited immediately above.

16. The liquid concentrate of claim 15 wherein the ratio of aromatic carboxylic acids to component (A) measured as its stoichiometric equivalent as $H_3PO_4$ is from 0.05:1 to 0.75:1.

17. The liquid concentrate of claim 15 wherein the concentration of aromatic carboxylic acids, including both dispersed and dissolved acids is at least 0.5% and is not more than 10%.

18. The liquid concentrate composition of claim 15 further comprising at least one member selected from the group consisting of (E) a component of phosphating accelerator that is not part of any of components (A) through (D);

(F) a component of dissolved fluoride ions that is not part of any of components (A) through (E);

(G) a component of chelating agent that is not part of compounds (A) through (F);

(H) a component of acidity adjustment agent that is not part of any of components (A) to (G); and (J) a component of one or more surfactants that is not part of any of components (A) through (H).

19. A liquid concentrate composition of matter that when mixed with 19 times its own mass of water is a solution that forms a phosphate conversion coating on a solid metal substrate with which it is contacted, said concentrate composition comprising water and:

(A) a component of dissolved phosphate anions in an amount of 2% to 40% by weight based on a stoichiometric equivalent as $H_3PO_4$;

(B) a component of sufficient dissolved acid to give the concentrate composition itself and a working composition made by diluting the concentrate composition with water only, an acidic pH value;

(C) a component of stably disbursed solid aromatic carboxylic acid, wherein the ratio of aromatic carboxylic acids to component (6) measured as its stoichiometric equivalent as $H_3PO_4$ is from 0.05:1 to 0.50:1; and (D) a component of viscosity increasing agent that is not part of any of components (A) through (C) as recited immediately above.

20. The liquid concentrate composition of claim 19 further comprising (E) a phosphating accelerator comprising at least two subcomponents (E.1) and (E.2) wherein (E.1) comprises a water soluble source of hydroxylamine and (E.2) comprises a member selected from the group consisting of nitroaromatic organic compounds, molybdate ions, condensed molybdate ions of the formula $Mo_nO_{(3n+1)}^{-2}$ wherein n represents a positive integer, tungstate ions, and mixtures thereof.

* * * * *

UNITED STATES PATENT AND TRADEMARK OFFICE

CERTIFICATE OF CORRECTION

PATENT NO. : 6,706,123 B2
DATED : March 16, 2004
INVENTOR(S) : Fristad et al.

It is certified that error appears in the above-identified patent and that said Letters Patent is hereby corrected as shown below:

Column 12,
Line 17, delete "8.1.00" and insert -- 8:1.00 --.
Line 33, delete "$H_3$=$PO_4$" and insert -- $H_3PO_4$ --.
Line 59, delete "Viscosity" and insert -- viscosity --.

Column 14,
Line 31, delete "(6)" and insert -- (A) --.

Signed and Sealed this

Seventh Day of February, 2006

JON W. DUDAS
*Director of the United States Patent and Trademark Office*